US005936914A

United States Patent [19]

Yamaguchi et al.

[11] Patent Number: 5,936,914

[45] Date of Patent: Aug. 10, 1999

[54] ELECTRONIC APPLIANCE EQUIPPED WITH LIGHT EMITTING APPARATUS

[75] Inventors: Masanobu Yamaguchi, Fussa; Tadao Hirano, Akiruno; Toshiyuki Suzuki, Fussa, all of Japan

[73] Assignee: Casio Computer Co., Ltd., Tokyo, Japan

[21] Appl. No.: 08/817,403

[22] PCT Filed: Aug. 14, 1996

[86] PCT No.: PCT/JP96/02297

§ 371 Date: Apr. 8, 1997

§ 102(e) Date: Apr. 8, 1997

[87] PCT Pub. No.: WO97/07438

PCT Pub. Date: Feb. 27, 1997

[30] Foreign Application Priority Data

Aug. 16, 1995 [JP] Japan ..... 7-229644
Aug. 29, 1995 [JP] Japan ..... 7-242367

[51] Int. Cl.[6] ..... G04B 1/00

[52] U.S. Cl. ..... 368/205; 368/228

[58] Field of Search ..... 368/223, 226, 368/227, 228, 232, 234, 239, 242, 67, 84, 82

[56] References Cited

U.S. PATENT DOCUMENTS 3,722,206 3/1973 Bergey ..... 368/67
4,247,930 1/1981 Martin ..... 368/84
4,413,915 11/1983 Besson ..... 368/71
4,459,035 7/1984 Nanya et al. ..... 368/241
4,488,084 12/1984 Lindfors et al. .
4,488,818 12/1984 Saurer et al. ..... 368/71
4,775,964 10/1988 Alessio et al. ..... 368/67
5,734,628 3/1998 Akasaka ..... 368/232

FOREIGN PATENT DOCUMENTS 37 38414 A1 5/1989 Germany .

OTHER PUBLICATIONS

Patent Abstracts of Japan; vol. 011, No. 243, Aug. 8, 1987 & JP A,62 052533 (Nippon Telegraph & Telephone Corp), Mar. 7, 1987.

*Primary Examiner*—Bernard Roskoski
*Attorney, Agent, or Firm*—Frishauf, Holtz, Goodman, Langer & Chick

[57] ABSTRACT

In an electronic appliance equipped with a light emitting apparatus 30, a transparent sheet member 31 having a character, a pattern or other symbols is arranged on a front surface of a transmission type flat-shaped light emitting apparatus 32. A colored sheet member 33 is arranged behind this light emitting apparatus. Openings 21 are formed in the colored sheet member 31, the light emitting apparatus 32, and the transparent sheet member 33. These openings are communicated therethrough. A pointer shaft 19 and 20 of a gear train mechanism 17 for indicating a present time is penetrated through the openings. Hands 22 and 23 are rotatably driven above the transparent sheet member 31. When the light emitting apparatus 32 is turned OFF, the colored sheet member 33 can be observed through the transparent sheet member 31 and the transparent light emitting apparatus 32. Accordingly, the colored sheet member 33 may provide high-grade quality and decorative feelings. When the light emitting apparatus 32 is turned ON, the emitted light can illuminate the hands 22 and 23 via the transparent sheet member 31.

16 Claims, 12 Drawing Sheets

ELECTRONIC APPLIANCE EQUIPPED WITH LIGHT EMITTING APPARATUS

DESCRIPTION

1. Technical Field

The present invention generally relates to an electronic appliance. More specifically, the present invention is directed to an electronic appliance equipped with a pointer whose position can be visually confirmed even in the dark, wherein a plane-shaped light emitting apparatus is arranged on a dial.

2. Background Art

Conventionally, electronic appliances, for instance, electronic watches employing EL (electroluminescent) elements for producing as so-called "back-light (back-surface illuminating light)" are known in the art. FIG. 20 schematically shows one conventional electronic wrist watch. As indicated in this drawing, a dial (face) 1 is arranged by a light emitting apparatus constituted by stacking an EL (electroluminescent) light emitting apparatus 1B behind a transparent film 1 along a light incident direction. The characters/numerals indicative of "hours" are printed on this transparent film 1A. An hour/minute hand shaft 2A is penetrated through an center opening 1C of this dial 1. A minute hand 2B and an hour hand 2C are mounted on this hand shaft 2A in such a manner that these hands 2B and 2C are rotated above the dial 1. In this electronic wrist watch, when the EL light emitting apparatus 1B emits light, the color of this dial 1 is illuminated in the emission color thereof. Accordingly, the characters/numerals indicative of "hours" printed on the dial 1, the minute hand 2B, and the hour hand 2C are illuminated, so that a present time is readable.

In the above-described conventional dial having the above-described light emitting apparatus, since an inorganic EL element is employed as the light emitting apparatus, the color of this face 1 is limited to the emission color of this inorganic EL element during not only turn-ON operation, but also turn-OFF operation. As a result, the conventional electronic wristwatch could not achieve high-grade quality and decorative feelings.

DISCLOSURE OF INVENTION

The present invention has been made to solve the above-explained problem, and therefore, has an object to provide an electronic appliance equipped with a light emitting apparatus, whose dial or face can be designed in various ways and can which can achieve high-grade quality and decorative feelings.

To achieve the above-mentioned object, an electronic appliance equipped with a light emitting apparatus, according to an aspect of the present invention, is comprised of:

- a transparent sheet member having an opening formed in an inner portion thereof, on which a character and a pattern are formed;
- a light emitting apparatus overlapped with a lower surface of said transparent sheet member and having an opening at a position opposite to said opening of the transparent sheet member;
- a colored sheet member overlapped with said light emitting apparatus and having an opening at a position opposite to said opening of the light emitting apparatus;
- a gear train mechanism arranged under said colored sheet member;
- a pointer shaft projected from said gear train mechanism through said openings of said colored sheet member, said transparent light emitting apparatus, and said transparent sheet member toward an upper portion of said transparent sheet member; and
- a hand mounted on said pointer shaft.

With employment of the above-described structure, in the electronic appliance of the present invention, when the light emitting apparatus is not driven, since the colored sheet member can be observed through the transparent sheet member and the transparent light emitting apparatus, this colored sheet member can provide high-grade quality and decorative feelings. When the light emitting apparatus is driven, the light emitted from this light emitting apparatus can illuminate the hands through the transparent sheet member.

BRIEF DESCRIPTION OF DRAWINGS

A more complete understanding of the teachings of the present invention may be acquired by referring to the accompanying drawings, in which.

BEST MODE OF CARRYING OUT THE INVENTION

Referring now to drawings, a description will be made of an embodiment of the present invention.

STRUCTURE OF FIRST ELECTRONIC WATCH HAVING ORGANIC EL ELEMENT

Figure 1:
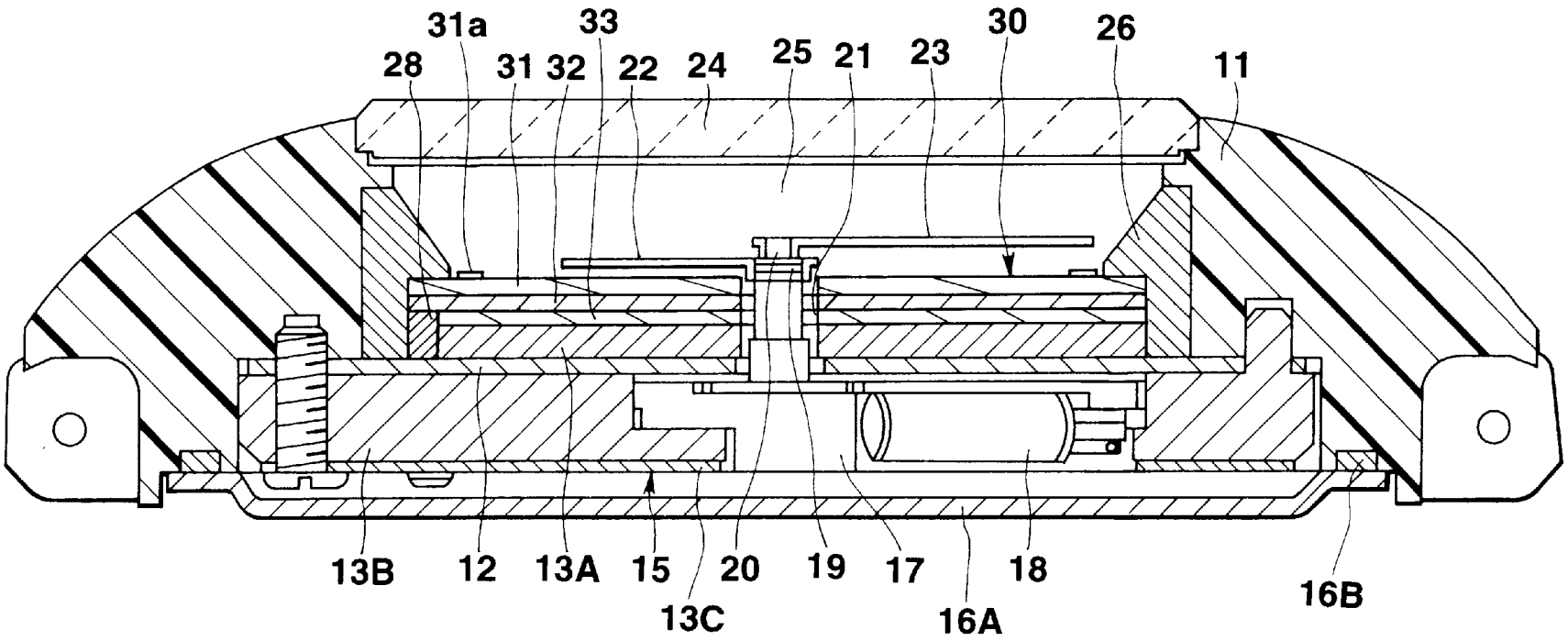
FIG. 1 is a sectional view for representing an electronic wrist watch to which the present invention is applied.

FIG. 1 represents a sectional view of an electronic wrist watch to which the present invention is applied.

A case 11 of this electronic wrist watch is shaped as a ring, the upper/lower surfaces of which are opened. Inside this case 11, a circuit board 12 is sandwiched by an upper housing 13A and a lower housing 13B to be assembled as a module 15, under such a condition that a metal plate 13C is arranged on a lower surface of this lower housing 13B. The upper housing 13A and the lower housing 13B are made of plate-like synthetic resin. Under such a circumstance that this module 15 is fixed to the case 11 by a screw 14, a rear lid 16A is mounted via a water-proof packing 16B on the case 11.

Furthermore, a gear train mechanism 17 of a hands type watch and a crystal oscillating element 18 are assembled in the module 15. A drive circuit (not shown) of the gear train mechanism 17, a drive circuit of a liquid crystal display apparatus (will be described later), and also a drive circuit of an EL light emitting apparatus are mounted on the circuit board 12.

From the gear train mechanism 17, an hour hand shaft 19 and a minute hand shaft 20, which are rotatably driven, are coaxially provided. These hour hand shaft 19 and minute hand shaft 20 pass from a center through hole 21 of a dial (face) apparatus 30 (will be discussed later) through the upper surface of this dial apparatus 30. Then, an hour hand 22 is mounted on the hour hand shaft 19, and a minute hand 23 is mounted on the minute hand shaft 20 in such a manner that these hour hand 22 and minute hand 23 are rotated above the dial apparatus 30. A transparent glass body (watch glass) 24 is fitted into the upper opening of the case 11 so as to close this upper opening. A ring-shaped partition plate 26 is mounted between this glass body 24 and the outer peripheral portion of the dial apparatus 30, by which a rotation space 25 for the hour hand 19 and the minute hand 20 is secured between this glass body 24 and the dial apparatus 30.

DETAILED STRUCTURE OF DIAL APPARATUS

The above-described dial apparatus 30 constructed of a light emitting apparatus is mounted on the upper surface of the module 15. This dial apparatus 30 comprises printed film 31 made by printing hour numerals or markers 31*a* on a transparent film using a fluorescent agent, an organic EL (electroluminescent) element 32 positioned behind this film 31, and a sheet-shaped decoration plate 33 having a different color from the emission color of the organic EL element 32 positioned behind this organic EL element 32 along a light travel path. The organic EL element 32 is electrically connected to the circuit board 12 by way of an interconnector 28 arranged which penetrates through the upper housing 13A.

Figure 2:
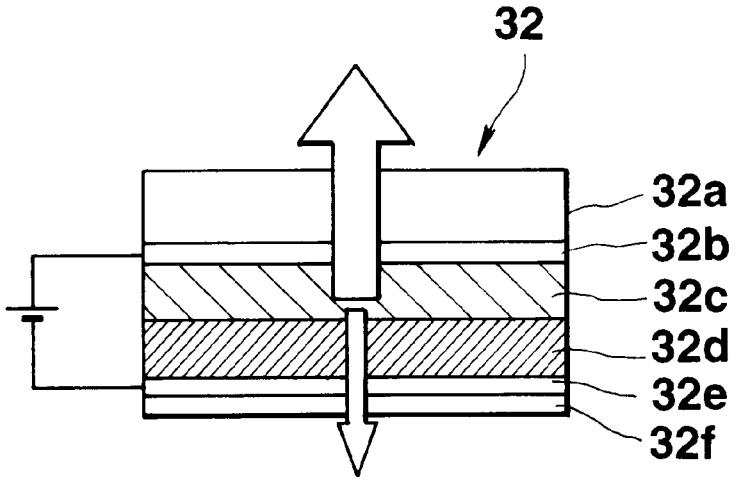
FIG. 2 is a sectional view for showing a structure of an organic EL element of the light emitting apparatus shown in FIG. 1.

The organic EL element 32 is characterized in that it becomes transparent when no voltage is applied, and emits the light when a voltage is applied. As indicated in FIG. 2, this EL element 32 is manufactured by stacking, in an integral form, a surface transparent electrode 32*b*, a hole transporting organic semiconductor+organic fluorescent pigment layer 32*c*, an electron transporting organic semiconductor 32*d*, a back surface transparent electrode 32*e*, a transparent insulating coat 32*f* in this order. This surface transparent electrode 32*b* is formed on an inner surface of a transparent substrate (PET, i.e., polyethylene terephthalate) 32*a*. Then, while using the surface transparent electrode 32*b* as an anode and the back surface transparent electrode 32*c* as a cathode, when a DC voltage is applied between both these transparent electrodes 32*b* and 32*e*, light is emitted from this organic EL element 32 with high intensity on the anode side, and low intensity on the cathode side. The decoration plate 33 is made of, for example, a colored-plastic film sheet, on which such a pattern capable of giving high-grade quality and decorative feelings is printed.

FUNCTIONS OF FIRST DIAL APPARATUS

In the first dial apparatus with the above-described structure, since the decoration plate 33 is arranged behind the organic EL element 32 which becomes transparent during the turn-OFF operation, the color and the pattern of this decoration plate 33 can be observed in a see-through manner. When the light is emitted from the organic EL element 32, since the printed film 31 is located on this organic EL element 32, the hour numerals or markers 31*a* can be illuminated by the light emitted from the organic EL element 32, and also both the hour hand 22 and the minute hand 23 can be illuminated. Accordingly, two different background colors can be produced, so that a present time can be visually read even in dark areas, and furthermore, the decorative features as well as high-grade feelings can be improved. When the fluorescent agent is employed to print out the hour numerals or markers 31*a*, the afterglow can occur in the hour numerals or markers 31*a* when the organic EL element 32 is turned OFF, resulting in an improvement in terms of visual recognition after turning-OFF of this organic EL element 32. It should be noted that when the electrode of the organic EL element 32 is shaped as a character or a pictorial pattern, the electrode of the organic EL element 32 may emit light having such a specific shape, resulting in better designs.

Alternatively, various characters, symbols, and pattern other than the above-described hour numerals or markers 31*a* may be printed on the printed film 31. Further, the hour numerals or markers 31*a* may be directly printed on the transparent substrate 32*a* of the organic EL element 32, which may be used as the printed film 31.

OTHER EXAMPLES OF DIAL APPARATUS 30

Figure 3:
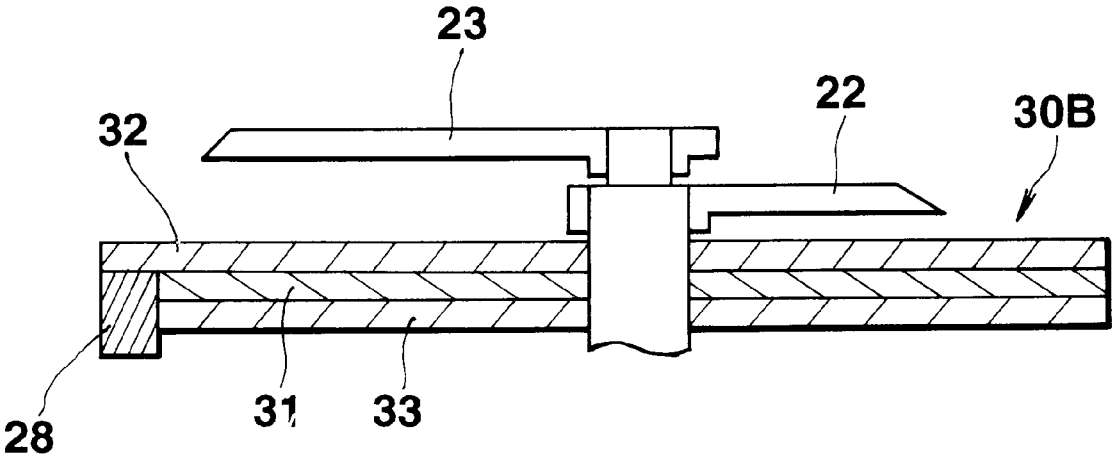
FIG. 3 is a sectional view for indicating an electronic wrist watch according to another embodiment of the present invention.

FIG. 3 schematically shows another example of a dial apparatus 30B.

In this dial apparatus 30B, the printed film 31 is sandwiched between the organic EL element 32 and the decoration plate 33. As a consequence, when the organic EL element 32 is turned OFF, namely when no illumination is required because of use in a light environment, the hour numerals or markers on this printed film 31 can be observed through the transparent organic EL element 32. When the organic EL element 32 is turned ON in a dark environment, the hour hand 22 and the minute hand 23 can be observed since the light is emitted from this organic EL element 32, so that a present time instant can be read. The illumination effect by the organic EL element 32 of this example may be increased, as compared with that of the organic EL element 32 shown in FIG. 1. As a result, this dial apparatus 30B may be utilized, for instance, as a flash light for illuminating surrounding areas.

Figure 4:
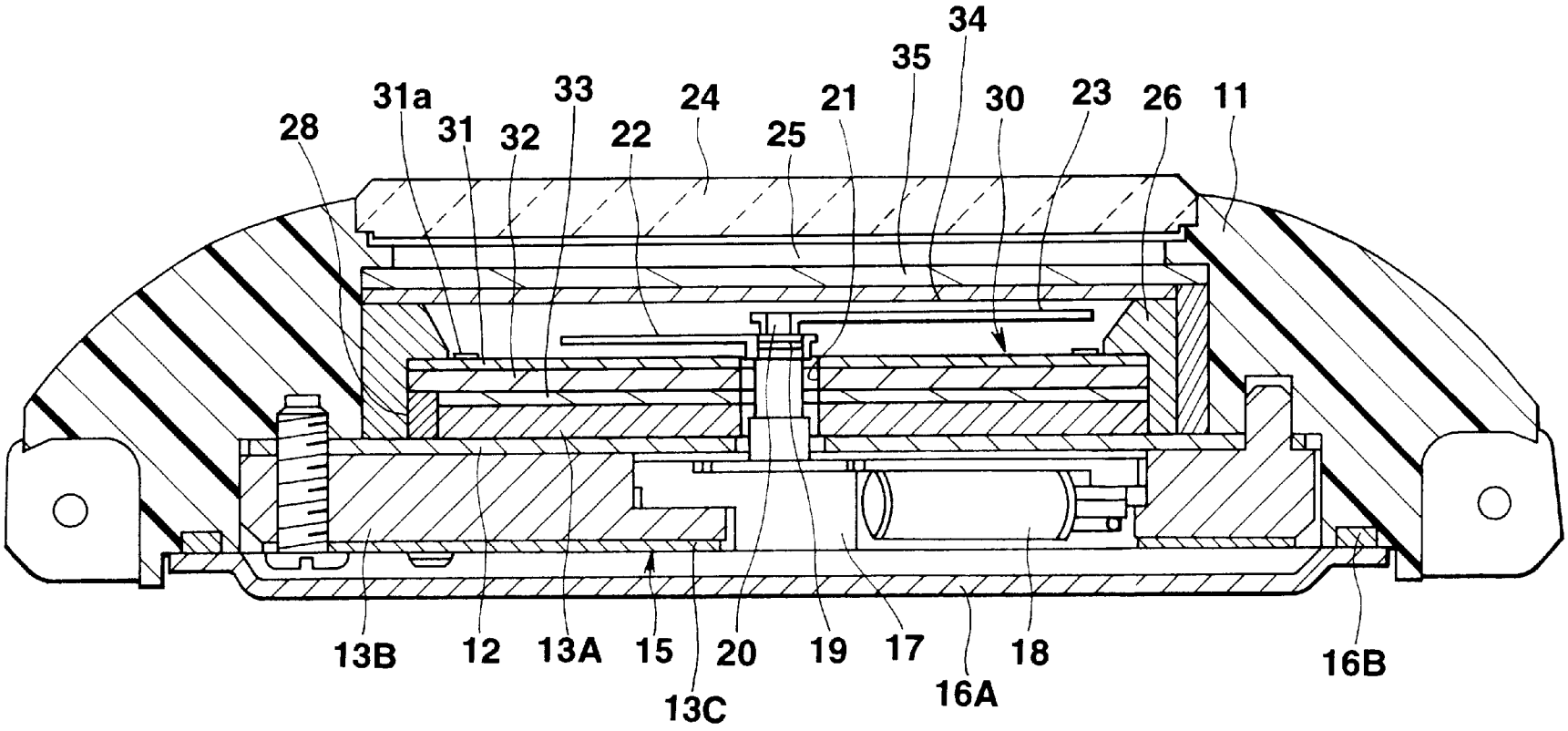
FIG. 4 is a sectional view for indicating an electronic wrist watch according to another embodiment of the present invention.

FIG. 4 represents an electronic wrist watch according to another embodiment of the present invention. It should be noted that the same reference numerals shown in FIG. 1 are employed as those for denoting the same or similar structures of FIG. 4, and explanations thereof are omitted.

In accordance with this embodiment, a semi-transparent reflection plate 34 is arranged above hands (namely, hour hand 22 and minute hand 23), and a transmission type liquid crystal display (LCD) apparatus 35 is arranged over this semi-transparent reflection plate 34. The liquid crystal display apparatus 35 is capable of displaying time and various sorts of data in a digital form. The information displayed on this liquid crystal display apparatus 35 is readable by utilizing the reflection light derived from the semi-transparent reflection plate 34. In such a case that no information display is made, or a small amount of information display is made, the hour/minute hands 22, 23, and the dial apparatus 30 may also be read. In this case, the color of this dial apparatus 30 is equal to the color of the decoration plate 33. When the dial apparatus 30 is driven to emit the light in night time, the color of the dial apparatus 30 becomes the color of the organic EL element 32, so that the hour hand 22 and the minute hand 23 can be visually read. Alternatively, both the semi-transparent reflection plate 34 and the liquid crystal display apparatus 35 may be arranged under the hour/minute hands 22/23, and further about the dial apparatus 30.

Figure 5:
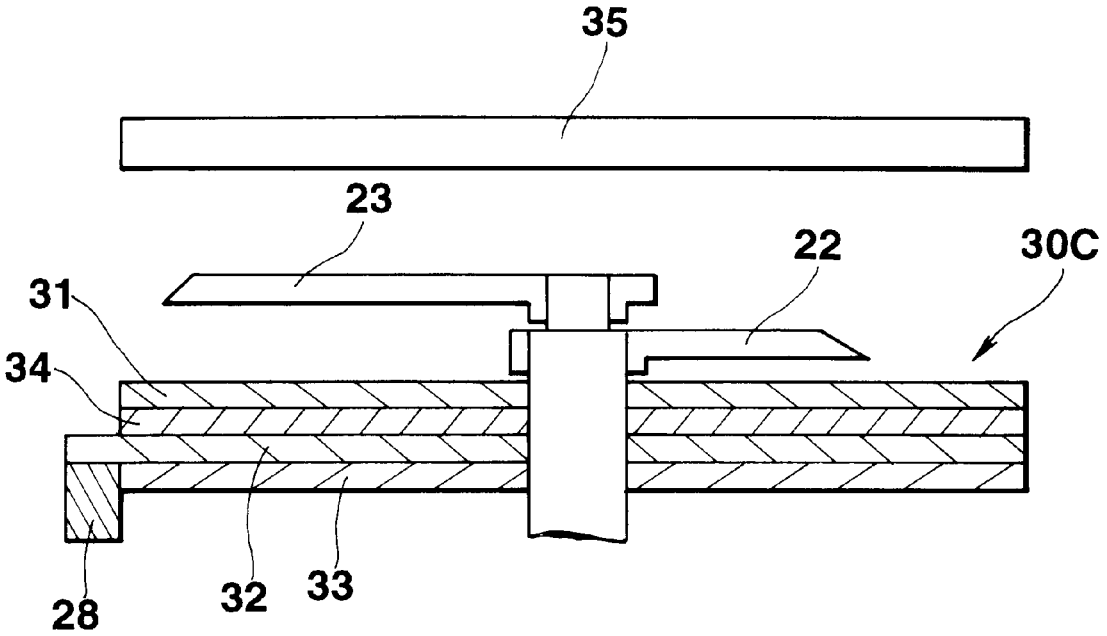
FIG. 5 is a sectional view for indicating an electronic wrist watch according to a further embodiment of the present invention.

FIG. 5 schematically indicates another embodiment of the present invention.

In accordance with this embodiment, the position of the semi-transparent reflection plate 34 indicated in FIG. 4 is changed. That is, a dial apparatus 30C is constituted by containing the semi-transparent reflection plate 34 which is arranged between the printed film 31 and the organic EL element 32. When the semi-transparent reflection plate 34 is arranged in this manner, the printed film 31 can be illuminated by the reflection light from the semi-transparent reflection plate 34 while the organic EL element 32 is turned OFF, whereas this printed film 31 can be illuminated by the light emitted from the organic EL element 32 while this organic EL element 32 is turned ON. As a consequence, the visual recognition of the hour numerals/chapters can be further improved in any of the reflection light/emission light.

Figure 6:
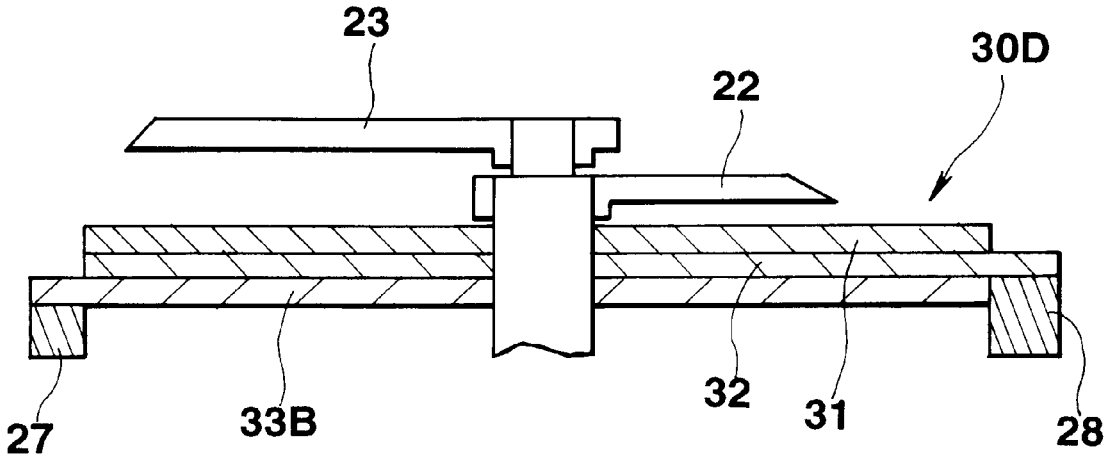
FIG. 6 is a sectional view for indicating an electronic wrist watch according to a still further embodiment of the present invention.

FIG. 6 schematically shows a dial apparatus 30D according to a further embodiment of the present invention.

In this dial apparatus 30D, a solar cell 33B is employed instead of the decoration plate 33 used in the first embodiment. The solar cell 33B is electrically connected to the circuit board by way of an interconnector 27. When this decoration plate 33 is substituted by the solar cell 33B, the background color of the organic EL element 32 during the OFF-state is equal to the color of this solar cell 33B. Also, since externally supplied light can reach the solar cell 33B when the organic EL element 32 is turned OFF, this solar cell 33B can generate electric energy, so that this generated electronic power can drive the electronic wrist watch.

It should also be noted that a solar cell may be employed in any of the above-described embodiments, instead of the decoration plates. Alternatively, as modifications related to the first and third embodiments, but the back face electrode (cathode) of the organic EL element 32 is made of a metal electrode. Then, this metal electrode may function as the decoration plate. In this modification case, the color of the metal electrode constitutes the background color when the organic EL element 32 is turned OFF.

While the light emitting apparatuses 30, 30B, 30C, and 30D have been applied to the respective electronic wrist watches in the respective embodiments, the present invention is not limited thereto, but may be similarly applied to many other electric appliances.

Moreover, instead of the above-explained organic EL element 32, any other light emitting elements which emit light in the drive mode and become transparent in the non-drive mode may be similarly utilized.

DETAILED STRUCTURE FOR MOUNTING DIAL APPARATUS

FIG. 7 to FIG. 11 represent another embodiment of the present invention, namely, indicate a mounting structure of a dial apparatus in detail. In the drawings, reference numeral 50 denotes a watch module (drive unit) for storing therein a circuit board, a crystal oscillating element, a gear train mechanism of an analog watch, and the like.

Figure 9:
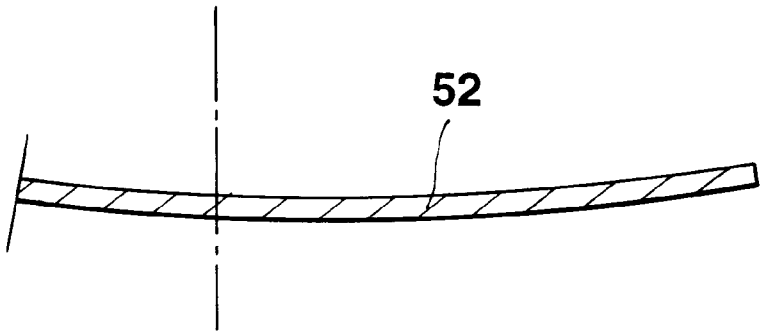
FIG. 9 is a side view for showing a shape of the face of FIG. 7.

On an upper surface of this watch module 50, a disk-shaped transparent organic EL element 51 and a dial (face) 52 are mounted in a stacking manner. In this case, the dial 52 is a disk-shaped transparent member having a surface on which hour numerals or markers 53 are printed. As indicated in FIG. 9, a center portion of this disk-shaped transparent dial 52 is curved along the rear surface direction to form a convex shape. A dial depressing member 54 is mounted on an outer peripheral portion of the watch module 51 so as to constitute the EL element 51 and the dial 52 in an integral form with this watch module 50.

Figure 10:
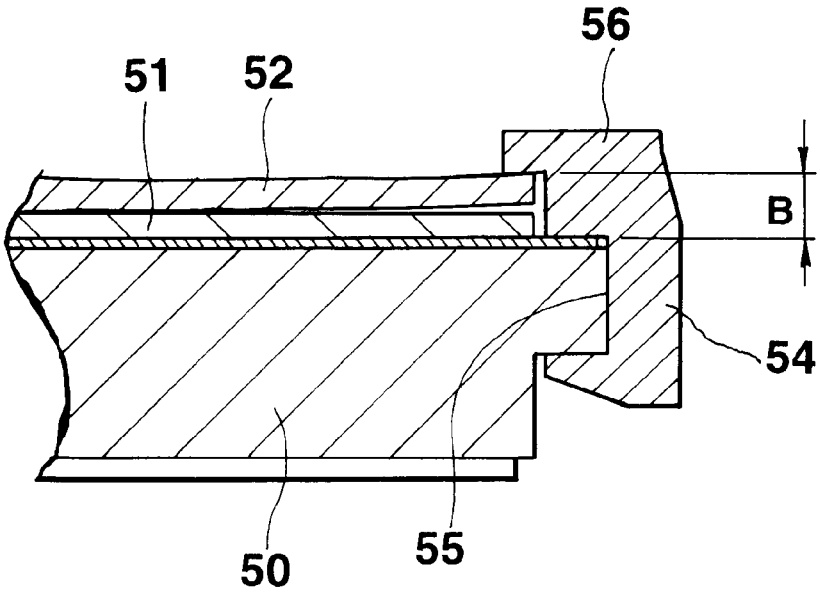
FIG. 10 is a sectional view for indicating a portion of the face mounting structure, taken along a ling A—A of FIG. 7.

This dial depressing member 54 is a ring-shaped member made of synthetic resin, and is mounted on an outer peripheral portion of the watch module 50 in such a manner that this outer peripheral portion of the watch module 50 is engaged with an inner peripheral groove 55. An upper hook portion 56 for hooking the EL element 51 and the peripheral portion of the dial 52 is formed on an upper edge portion of this dial depressing member 54. In this case, as shown in FIG. 10, the dial depressing member 54 is manufactured in such a manner that a height "B" defined from the upper edge portion of this inner peripheral groove 55, namely the upper surface position of the watch module 50 up to the upper hook portion 56 becomes slightly larger than a summation between a thickness of the EL element 51 and a thickness of the dial 52.

Figure 7:
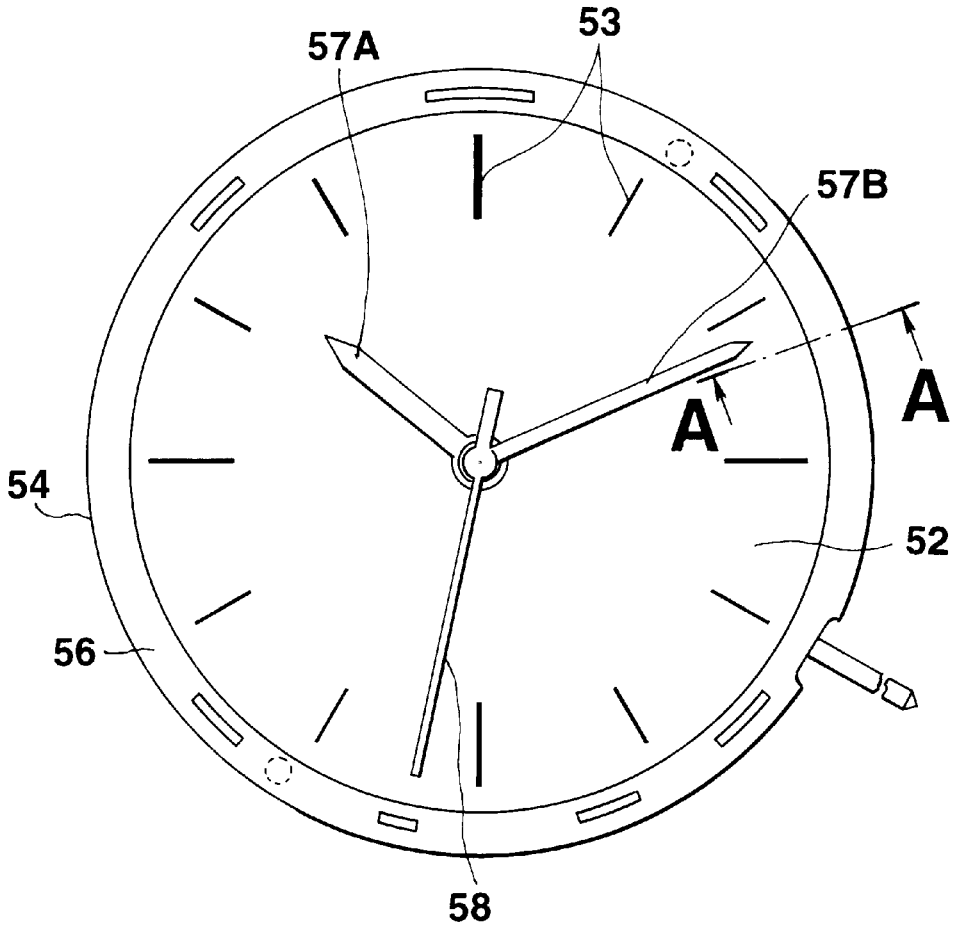
FIG. 7 is a plane view for representing a mounting structure of a face of an electronic wrist watch according to another embodiment of the present invention.
Figure 8:
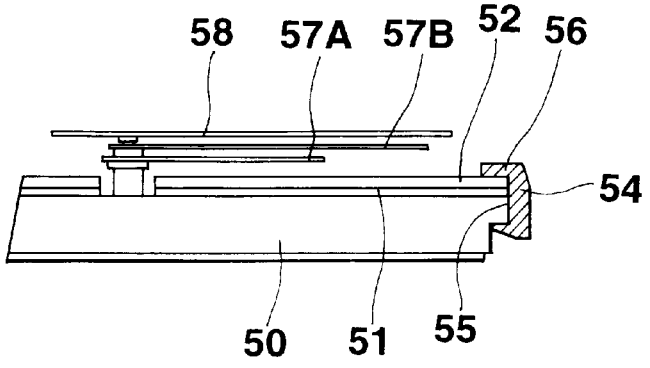
FIG. 8 is a cross-sectional view for indicating a major portion of FIG. 7.
Figure 11:
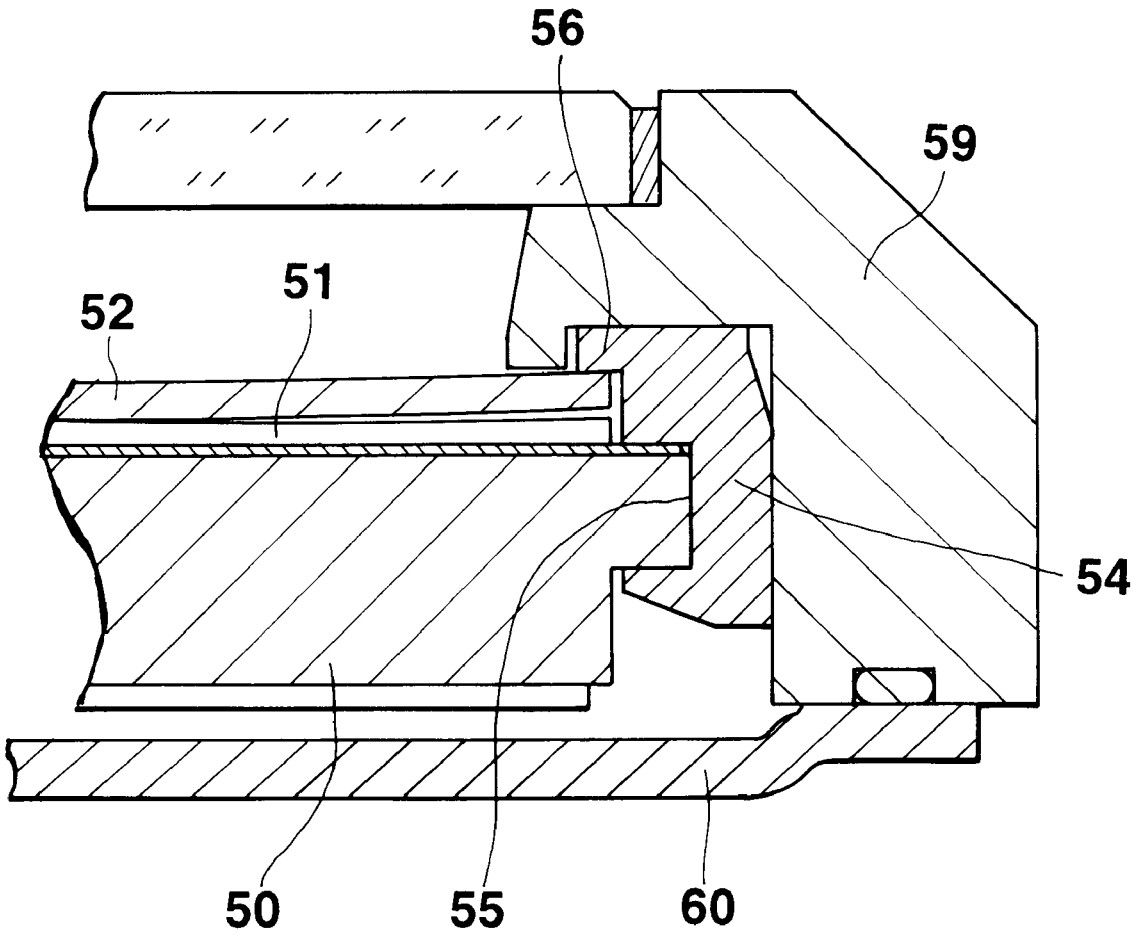
FIG. 11 is a cross-sectional view for partially showing an assembling condition that the structure of FIG. 1 is assembled into a casing of an electronic wrist watch.

The watch module 51 in which the EL element 51 and the dial 52 are made in an integral form by the dial depressing member 54 in the above-described manner is constructed as a unit on which a hour hand 57A, a minute hand 57B, and a second hand 58 are mounted, as illustrated in FIG. 7 and FIG. 8. As shown in FIG. 11, this watch module 50 is assembled within a case 59 of an electronic wrist watch through a rear surface opening of this case 59. Furthermore, this rear surface opening of the case 59 is closed by a back plate 60.

According to the mounting structure of the dial 52 made of the above-described structure, the following merit can be achieved. That is, the outer peripheral portion of the watch module 50 is engaged with the inner peripheral groove 55 of the dial depressing member 54. Furthermore, the dial depressing member 52 is fabricated in such a way that the height "B" defined from the upper surface position of the watch module 50 up to the upper hook portion 56 for hooking the EL element 51 and the peripheral portion of the dial 52 becomes larger than the summation between the thickness of the EL element 51 and the thickness of the dial 52. As indicated in FIG. 11, when these members are assembled in the case 59, even when the depressing force is exerted from the watch module 50 to the dial depressing member 54, this depressing force is not given to the EL element 51. As a consequence, there is no such a risk that the EL element 51 having flexibility is conventionally deformed, and therefore the center portion of the dial 52 is floated upwardly.

In addition, as indicated in FIG. 9, since the center portion of this dial 52 is curved toward the EL element 51 in a convex shape, even when the above-defined height "B" is made larger than the summation between the thickness of the EL element 51 and the thickness of the dial 52, a space produced between both members can be absorbed by the curved dial. As a consequence, it is possible to avoid a play produced between these members.

On the other hand, FIG. 12 to FIG. 19 indicate a further embodiment according to the present invention.

Figure 12:
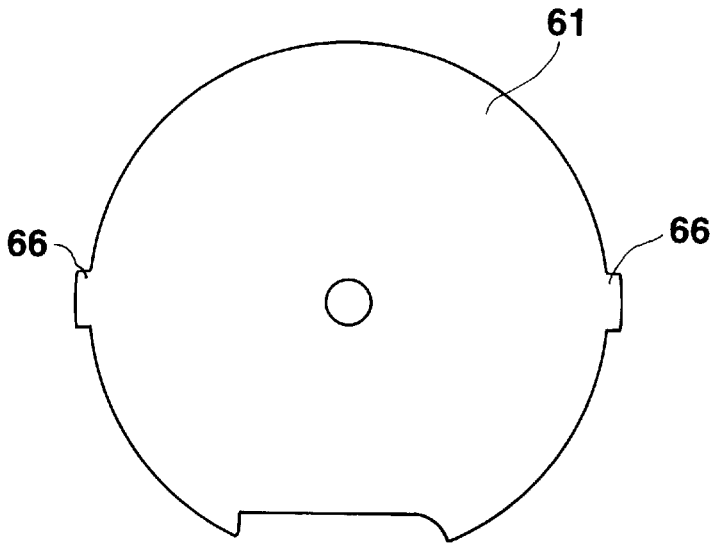
FIG. 12 schematically indicates a metal face used in an electronic wrist watch according to another embodiment of the present invention.
Figure 13:
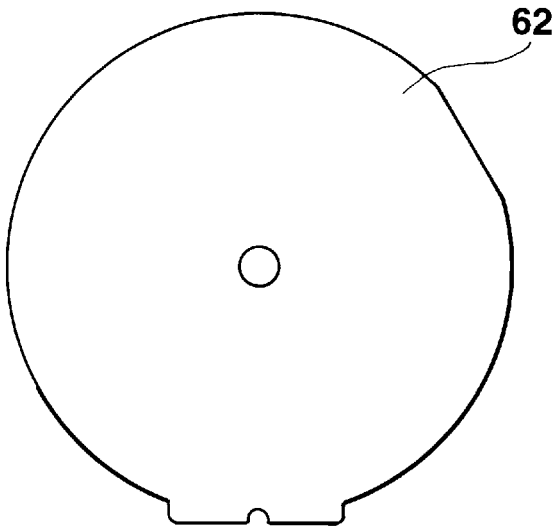
FIG. 13 is a plan view for showing an EL element used in the electronic wrist watch according to another embodiment of the present invention.
Figure 14:
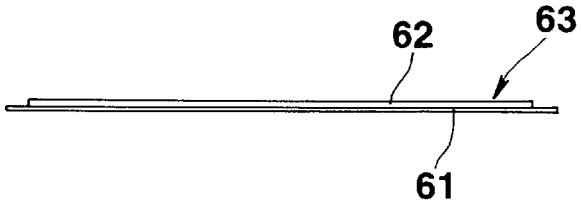
FIG. 14 is a side view for indicating a structure for combining the EL element of FIG. 13 and the metal face of FIG. 12.
Figure 15:
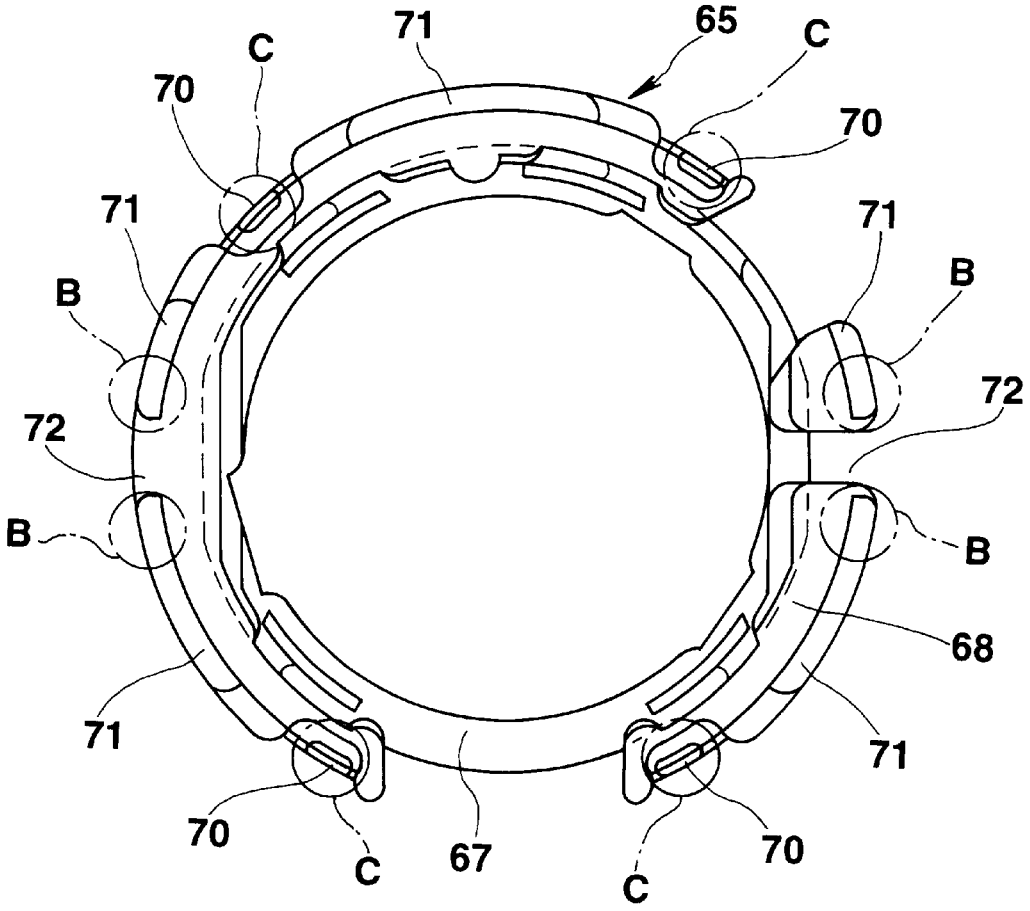
FIG. 15 is a plan view for representing a frame member of FIG. 11.
Figure 16:
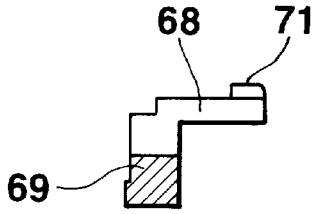
FIG. 16 is a cross-sectional view for indicating a portion "B" of the frame member shown in FIG. 15.
Figure 17:
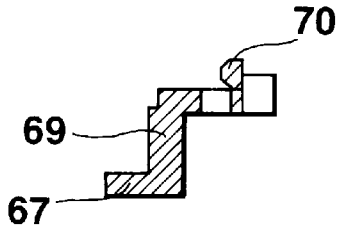
FIG. 17 is a cross-sectional view for representing a portion "C" of the frame member shown in FIG. 15.
Figure 18:
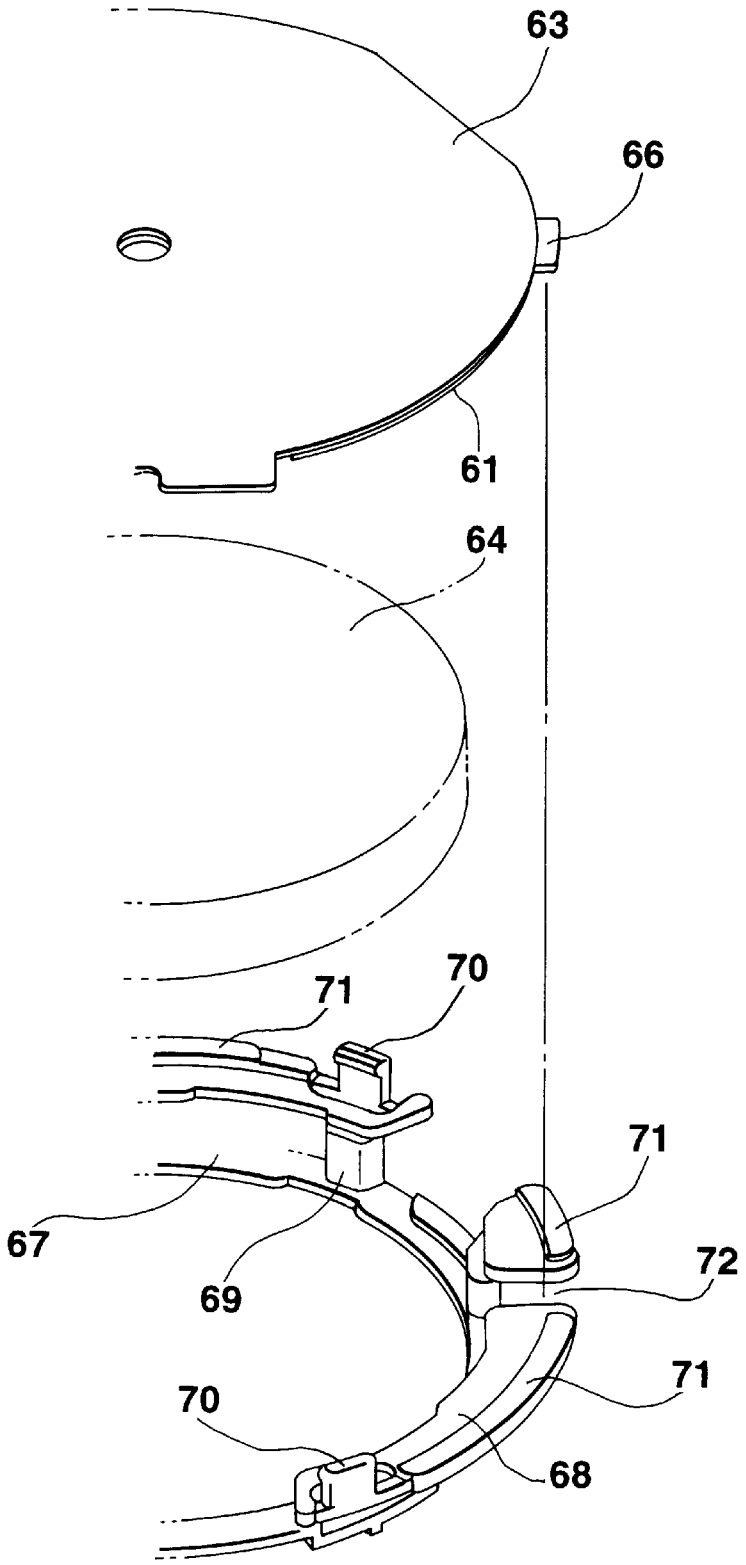
FIG. 18 is a fragmentary perspective view for showing a major portion of a mounting condition that a face and a watch module are mounted on the frame member of FIG. 15.

As shown in FIG. 12 to FIG. 14, a disk-shaped dial 63 according to this embodiment is mounted as follows. That is, a transparent organic EL element 62 having a surface on which hour numerals/chapters (not shown in detail) is formed is adhered to a thin-metal plate 61 with a higher strength such as SUS631 by employing acrylic ad-hesive agent and the like to thereby form an integral form. A pattern and the like are coated on a surface of this thin-metal plate 61. Tongue-shaped portions 66 and 66 projected along the diameter direction respectively are formed at a 3:00-position and a 9:00-position opposite to the diameter direction of the metal plate 61. Then, the watch module 64 and the dial plate 63 are assembled in an integral body by a frame member 65 in this electronic wrist watch, as illustrated in FIG. 15 to FIG. 19.

This frame member 65 is a member made of synthetic resin by combining a ring-shaped bottom plate 67 with an upper edge portion (peripheral edge portion of opening) 68 by using a plurality of pillars 69 to thereby form an integral body. A height of the pillar 69 is made substantially equal to a thickness of the watch module 64. Hook portions 70 are formed on the upper edge portion 68 at plural positions thereof along the circumferential direction, and the outer peripheral portion of the dial 63 is engaged with these hook portions 70. Stepped portions 71 are formed among these hook portions 70 and projected from the upper edge portion 68 so as to engage the outer peripheral portion of the dial 63. Grooves 72 and 73 engageable with the tongue portions 66 of the metal plate 61 are formed at a 3:00-position and a 9:00-position of this upper edge portion 68. Furthermore, an outer dimension of this frame member 65 is designed so as to be closely fitted to a casing 73 into which this frame member 65 is assembled.

Then, the watch module 64 is mounted on the bottom plate 67 of this frame member 65. The dial 63 is mounted on this watch module 64 in such a manner that the tongue portions 66 thereof are positioned into the grooves 72. Also, the outer peripheral portion of the dial 63 is engaged with the hook portions 70. As a result, the movement of the dial 63 along the upper/lower directions is blocked by the hook portions 70. Also, the movement of this dial 63 along the radial direction is blocked by the stepped portion 73. Furthermore, this dial 63 is mounted on the frame member 65 under such a condition that the movement thereof along the circumferential direction is blocked by the grooves 72.

Figure 19:
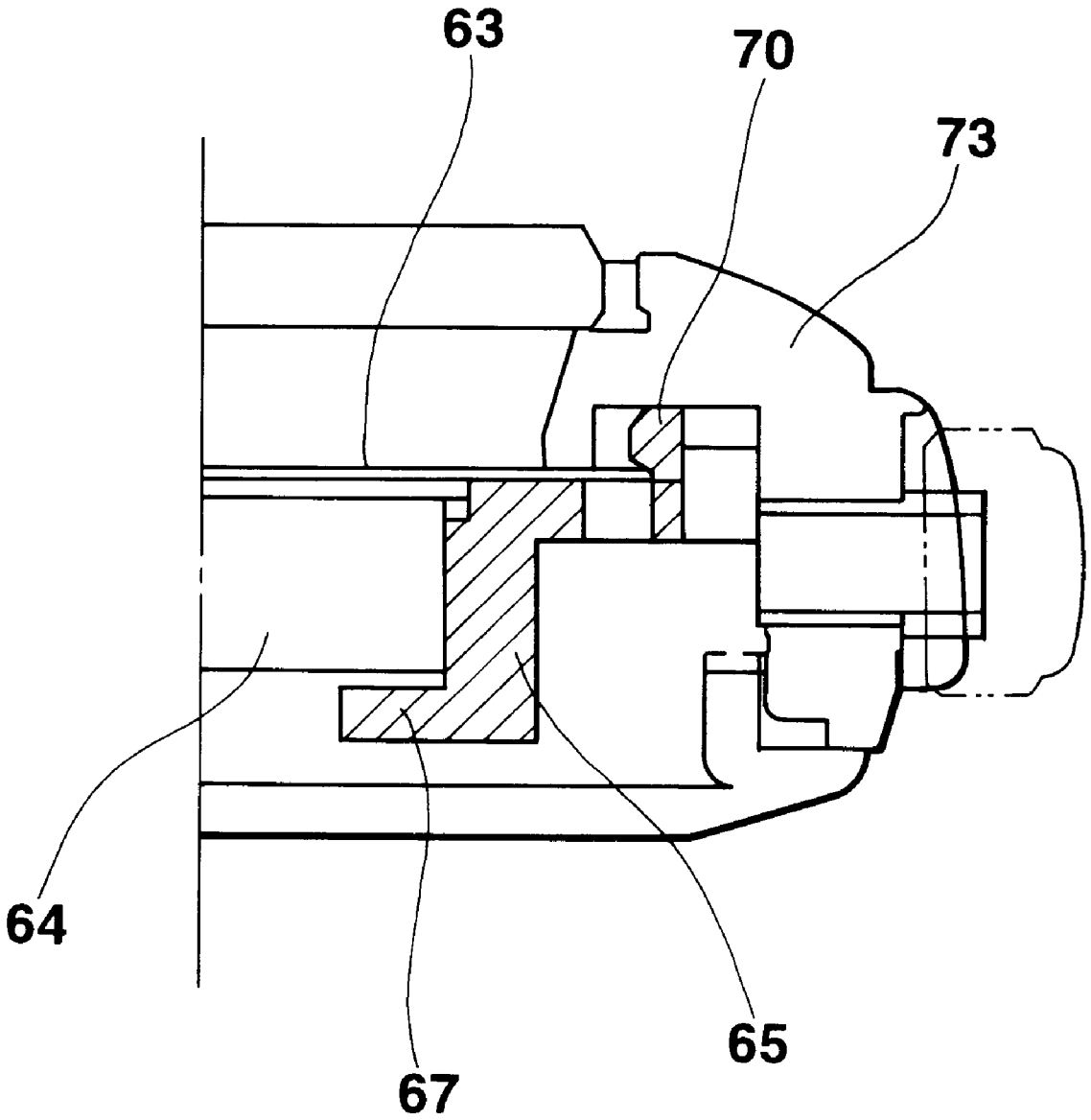
FIG. 19 is a cross-sectional view for representing a major portion of a mounting condition that the watch unit of FIG. 18 is assembled into a casing of an electronic wrist watch.
Figure 20:
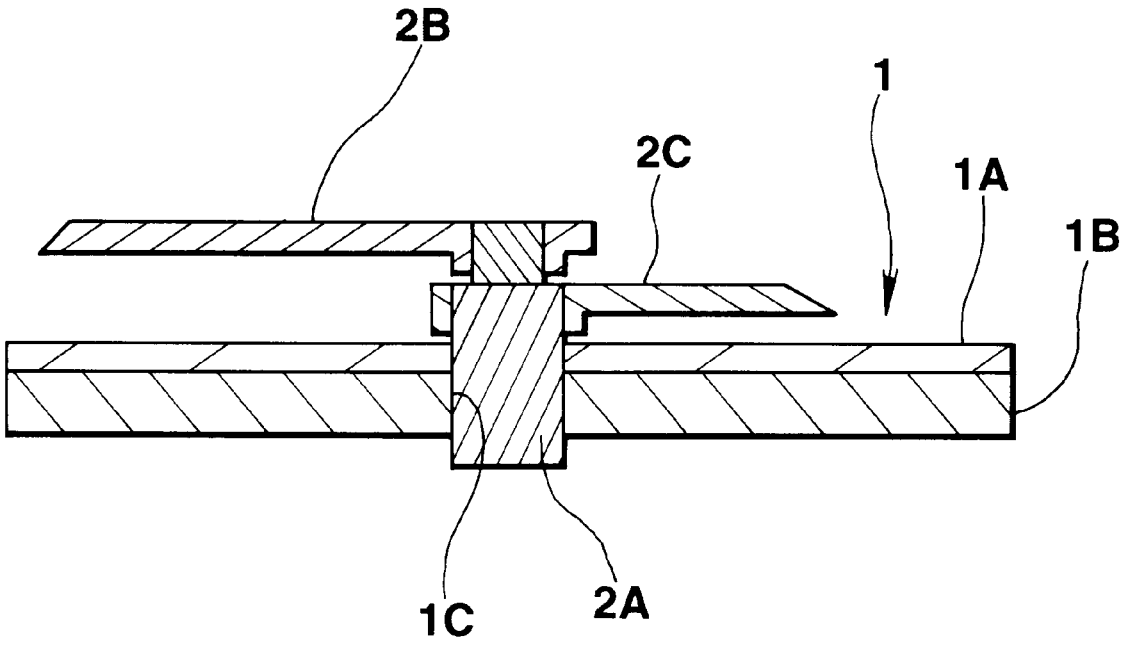
FIG.20 PRIOR ART
FIG. 20 is the sectional view for indicating the conventional electronic wrist watch having the face mounted on the drive unit.

As represented in FIG. 19, both the watch module 64 and the dial 63 which are assembled by the-frame member 65 in an integral form in this manner are assembled into the casing 73 of this electronic watch.

As previously described, with respect to the mounting structure of the dial, the dial 63 to which the metal plate 61 and the EL element 62 are adhered in an integral form is fixed in such a manner that the tongue portions 66 are fitted into the grooves 72 of the frame member, and further the outer peripheral portion thereof is engaged with the hook portion 70. Accordingly, the movement of this dial 63 along the plate-thickness direction is blocked by the hook portions, and the movement thereof along the plate-surface direction is blocked by the stepped portions 71. Also, the rotational movement of this dial 63 along the circumferential direction is blocked by the grooves 72. As a consequence, a mounting leg such as that used in the prior art is no longer required to join the dial, so that such a metal material having high strength, for instance, a stainless steel can be selected as the metal plate 61, and further this dial 63 can be firmly fixed on the frame member 65.

Moreover, since the outer dimension of the frame member 65 is set so as to be closely fitted to the casing 73 into which this frame member is assembled, it is possible to avoid a play produced between the dial 63 and the watch module 64 within the casing 73.

It should be noted that the dial mounting structures of the embodiments of the present invention have been applied to those of the analog watch and the pocket watch. However, the present invention is not limited to these applications, but may be applied to other dial mounting structures in electronic appliances.

Also, the light emitting element is not limited to the above-described EL element, but may be similarly applied to various sorts of light emitting elements mounted on the above-described drive unit with the dial in a stacked layer.

We claim:

1. An electronic appliance comprising:

a transparent sheet member having an opening formed at an inner portion thereof, said transparent sheet member having at least one of a character and a pattern formed thereon;

an electroluminescent element which is transparent when no voltage is applied thereto and which emits light when a voltage is applied thereto, said electroluminescent element being overlapped with a lower surface of said transparent sheet member and having an opening at a position opposite to said opening of said transparent sheet member;

a colored sheet member formed of a solar cell overlapped with a lower surface of said electroluminescent element and having an opening at a position opposite to said opening of said electroluminescent element;

a gear train mechanism arranged under said colored sheet member;

a pointer shaft projected from said gear train mechanism through said openings of said colored sheet member, said electroluminescent element, and said transparent sheet member toward an upper portion of said transparent sheet member; and a pointer mounted on said pointer shaft.

2. The electronic appliance according to claim 1, wherein said electroluminescent element comprises an organic electroluminescent element.

3. The electronic appliance according to claim 1, wherein said transparent sheet member has hour numeral markers printed thereon.

4. The electronic appliance according to claim 1, further comprising a circuit board including a drive circuit for driving said electroluminescent element, said circuit board being positioned below said colored sheet member.

5. The electronic appliance according to claim 1, wherein said pointer comprises an hour hand and a minute hand for indicating a present time.

6. The electronic appliance according to claim 1, wherein said electronic appliance comprises a wrist watch.

7. The electronic appliance according to claim 1, wherein said colored sheet member comprises a metal material.

8. The electronic appliance according to claim 1, further comprising a liquid crystal display apparatus positioned above said transparent sheet member.

9. An electronic appliance comprising:

an electroluminescent element which is transparent when no voltage is applied thereto and which emits light when a voltage is applied thereto, said electroluminescent element having an opening formed at an internal portion thereof and having an upper surface on which at least one of a character and a pattern are formed;

a colored sheet member formed of a solar cell overlapped with a lower surface of said electroluminescent element, said colored sheet member having an opening at a position opposite to said opening of said electroluminescent element;

a gear train mechanism arranged under said colored sheet member;

a pointer shaft projected from said gear train mechanism through said openings of said colored sheet member and said electroluminescent element toward an upper portion of said electroluminescent element; and a pointer mounted on said pointer shaft.

10. The electronic appliance according to claim 9, wherein said electroluminescent element comprises an organic electroluminescent element.

11. The electronic appliance according to claim 9, wherein said electroluminescent element has hour markers printed on said upper surface thereof.

12. The electronic appliance according to claim 9, further comprising a circuit board including a drive circuit for driving said electroluminescent element, said circuit board being positioned below said colored sheet member.

13. The electronic appliance according to claim 9, wherein said pointer comprises an hour hand and a minute hand for indicating a present time.

14. The electronic appliance according to claim 9, wherein said electronic appliance comprises a wrist watch.

15. The electronic appliance according to claim 9, wherein said colored sheet member comprises a metal material.

16. The electronic appliance according to claim 9, further comprising a liquid crystal display apparatus positioned above said electroluminescent element.

* * * * *